US005196216A

United States Patent [19]

Lynch et al.

[11] Patent Number: 5,196,216

[45] Date of Patent: Mar. 23, 1993

[54] BEVERAGE PACKAGE

[75] Inventors: Francis J. Lynch, Glenageary; Joseph B. Whyte, Luca, both of Ireland

[73] Assignee: Guinness Brewing Worldwise Limited, London, Great Britain

[21] Appl. No.: 900,854

[22] Filed: Jun. 18, 1992

[30] Foreign Application Priority Data

Jun. 25, 1991 [GB] United Kingdom ..... 9113649
Jan. 29, 1992 [GB] United Kingdom ..... 92300759

[51] Int. Cl.[5] ..... B65D 1/24; B65D 85/72

[52] U.S. Cl. ..... 426/112; 426/115; 426/131; 220/501; 206/221; 215/DIG. 8

[58] Field of Search ..... 206/221, 219; 220/501, 220/502; 215/DIG. 8; 426/112, 115, 124, 126, 131, 394, 398, 407

[56] References Cited

U.S. PATENT DOCUMENTS

| | | | |
|---|---|---|---|
| 3,240,403 | 3/1966 | Modderno | 206/221 |
| 4,116,354 | 9/1978 | Kenkare et al. | 206/221 |
| 4,410,085 | 10/1983 | Beneziat et al. | 206/219 |
| 4,779,722 | 10/1988 | Hall | 206/221 |
| 4,832,968 | 5/1989 | Forage et al. | 426/112 |
| 4,858,759 | 8/1989 | Mauthe et al. | 206/221 |
| 4,995,218 | 2/1991 | Byrne | 206/131 |
| 4,996,823 | 3/1991 | Byrne | 426/131 |
| 5,009,901 | 4/1991 | Byrne | 426/112 |

*Primary Examiner*—Joseph Man-Fu Moy

[57] ABSTRACT

A beverage package has a sealed can 1 containing beer 5 with gas in solution and a headspace 6 containing gas at a pressure greater than atmospheric. An insert 7 in the beer has a secondary chamber 13 containing gas at a pressure greater than atmospheric and which communicates through an aperture 15 with an intermediate chamber 14 having an open end 12 and containing beer 5A. On opening the container, headspace 6 depressurises causing gas to be ejected from chamber 13 through aperture 15 and gas to be evolved from solution in the beer 5A. Such evolution rises through the beer 5A to emerge into the beer 5 above the chamber opening 12 to form a head of froth. The open end 12 of the chamber 14 can be located in the headspace 6. The wall 9 of the chamber 14 isolates a major part of the beer in the container from having its gas liberated so that such gas can evolve gradually and naturally to provide sparkle in the beer.

11 Claims, 2 Drawing Sheets

BEVERAGE PACKAGE

TECHNICAL FIELD and BACKGROUND ART

The present invention relates to a beverage package. More particularly it concerns beverages containing gas, such as carbon dioxide and/or nitrogen, in solution and packaged in a sealed container which, when opened for dispensing or consumption, causes gas to be evolved or liberated from the beverage to form, or assist in the formation of, a head of froth on the beverage. The beverages to which the invention relates may be alcoholic or non-alcoholic; primarily the invention was developed for fermented beverages such as ale, lager, stout or other beer and cider but may be applied with advantage to so-called soft drinks and beverages, or alcoholic drinks such as spirits, liquers, wine and the like.

Beverage packages are known which comprise a sealed container having a primary chamber containing the beverage having gas in solution and forming a primary headspace comprising gas at a pressure greater than atmospheric and in which a secondary chamber containing gas at a pressure greater than atmospheric has a restricted orifice which communicates with the beverage in the primary chamber. Upon opening the package to dispense the beverage, the primary headspace is opened to atmospheric pressure and this creates a pressure differential within the container which causes gas and/or beverage in the secondary chamber to be ejected by way of the restricted orifice into the beverage in the primary chamber. The ejection of the gas or beverage from the secondary chamber and through the restricted orifice causes gas in solution in the beverage to be evolved for froth formation. Examples of beverage packages having the latter characteristics are disclosed in our European Patent Specification No. 0 227 213 (where it is preferred that beverage is ejected from the secondary chamber for the purposes of froth development) and our British Patent No. 1,266,351 (where gas is ejected from the secondary chamber, possibly through a non-return valve, for the purposes of froth development).

Our aforementioned prior Patents discuss the manner in which it is believed that gas in solution in the beverage is caused to be evolved to develop a desirable head of froth on the beverage by the ejection of gas and/or liquid from the secondary chamber through the restricted orifice. This technique for froth development is now well known in the art.

In the known beverage packages of the kind discussed above the restricted orifice is located at or towards the bottom of the beverage in the primary chamber. When the package is opened and gas and/or liquid/beverage is ejected through the restricted orifice, gas in solution is initially evolved in the region of the beverage which is local to the restricted orifice and this evolution of gas develops or grows rapidly to rise throughout the volume of beverage in the primary chamber to develop a head of froth which is retained when the beverage is dispensed from the container. For some beverages, particularly those containing carbon dioxide in solution (with or without nitrogen gas in solution) it is possible for a major part, if not all, of the gas in solution to be evolved from the beverage shortly after the gas or beverage has been ejected from the secondary chamber on opening the package. As a consequence, when the beverage is dispensed from the container into a drinking glass for consumption, it is possible that the absence, or low level, of gas in solution in the beverage will impart undesirable characteristics to the beverage (albeit that such beverage may have a good quality head of froth). This is particularly the case for so-called light beers or lagers where it is preferred that a reasonable volume of gas, usually carbon dioxide, is retained in solution in the beverage as dispensed in a drinking glass so that such gas can evolve naturally to rise as minute bubbles within the beverage and the latter retains a "sparkle" which is considered desirable aesthetically and can add to the consumer's enjoyment and "mouth feel" of the beverage. It is an object of the present invention to provide a beverage package of the kind generally discussed and by which the aforementioned disadvantage of excessive liberation of gas in solution can be alleviated so that the beverage when dispensed will retain a desirable "sparkle" without detracting from the desirable characteristics required for froth development in forming a head on the beverage.

STATEMENT OF INVENTION and ADVANTAGES

According to the present invention there is provided a beverage package comprising a sealed container having a primary chamber containing beverage having gas in solution therewith and forming a primary headspace comprising gas at a pressure greater than atmospheric; a secondary chamber containing gas at a pressure greater than atmospheric and having a restricted orifice which communicates with an intermediate chamber containing beverage, said intermediate chamber opening to the primary chamber at a position remote from the bottom of the beverage in the primary chamber, and wherein said package is openable to open the primary headspace to atmospheric pressure and said opening creates a pressure differential causing gas and/or beverage in the secondary chamber to be ejected by way of the restricted orifice into the beverage in the intermediate chamber and said ejection causes gas in solution to be evolved from the beverage in the intermediate chamber for forming froth in the primary headspace. Preferably and conveniently the beverage in the intermediate chamber is derived from the primary chamber.

Usually each of the secondary and intermediate chambers will have a volume considerably less than that of the primary chamber. The intermediate chamber may therefore be filled with a relatively small volume of beverage, conveniently in the form of a column, into which is injected gas and/or liquid which emanates from the restricted orifice so that gas in solution in the beverage in the intermediate chamber is evolved to develop and rise, through the beverage in the intermediate chamber to form a froth in the primary headspace on the beverage in the primary chamber.

The intermediate chamber may open, at a relatively high level, into the beverage in the primary chamber. With this arrangement initial evolution of gas from the beverage is contained within the intermediate chamber and this evolution may develop through the beverage in the intermediate chamber into the beverage in the primary chamber remote from the bottom of that beverage. As a consequence, the relatively high energy available from the injected gas or beverage can be dissipated, wholly or to a substantial extent, through the beverage within the intermediate chamber and there is relatively little energy available to effect evolution of the gas from the solution in the transition through the beverage from that in the intermediate chamber to that in the primary chamber. Alternatively the intermediate chamber may open into the primary headspace above the beverage in the primary chamber. With this latter arrangement evolution of gas from the beverage is confined to the beverage in the intermediate chamber and froth developed from such evolution and from the beverage in the intermediate chamber may flow into the primary headspace and be dispensed with the beverage. By the present invention therefore at least a desirable proportion of gas, typically carbon dioxide, can be maintained in solution in a reasonably large proportion, or the whole, of the volume of the beverage in the primary chamber even though adequate gas may be evolved for the development of froth as a substantial head. Therefore when the beverage is dispensed into a glass or other container, gas can continue to evolve from solution to maintain "sparkle" and other characteristics considered desirable for the product.

Preferably the restricted orifice is located at or towards the bottom of the container and the intermediate chamber extends upwardly from its communication with the restricted orifice to open into the beverage in the primary chamber at a required depth beneath the surface of the beverage in the primary chamber or into the primary headspace. Desirably the restricted orifice (or two or more such orifices) is directed downwardly from the secondary chamber for the ejection of gas or beverage under pressure from the secondary chamber into the intermediate chamber to alleviate the possibility of inadvertant excess beverage flow from the intermediate chamber into the secondary chamber caused by vibration of the sealed beverage package during its transportation. It will be appreciated however that the restricted orifice or orifices can be located to effect gas and/or beverage injection sideways or upwardly into the beverage in the intermediate chamber.

The secondary and intermediate chambers may be built-in as an integral part of the container. Preferably however the secondary and intermediate chambers are formed as an insert that is located in the primary chamber of the container. Typically this insert will have a hollow part forming the secondary chamber and a tubular part extending upwardly from the hollow part, the tubular part forming the intermediate chamber and having its upper end open to receive therethrough beverage (usually from the primary chamber) while the restricted orifice from the secondary chamber communicates with a lower or the bottom end of the intermediate chamber in the tubular part. Conveniently the insert is formed as a plastics moulding. The insert will usually be located adjacent to or on a base of the container within the primary chamber and retained in position by any convenient means, such as by frictional or interference engagement with a side wall of the container. Where the intermediate chamber opens into the primary headspace it may be necessary to invert and re-invert the beverage package after sealing to ensure that the intermediate chamber is adequately charged with beverage derived from the primary chamber.

DRAWING

Two embodiments of a beverage package constructed in accordance with the present invention will now be described, by way of example only, with reference to the accompanying illustrative drawings in which.

DETAILED DESCRIPTION OF DRAWING

Figure 1:
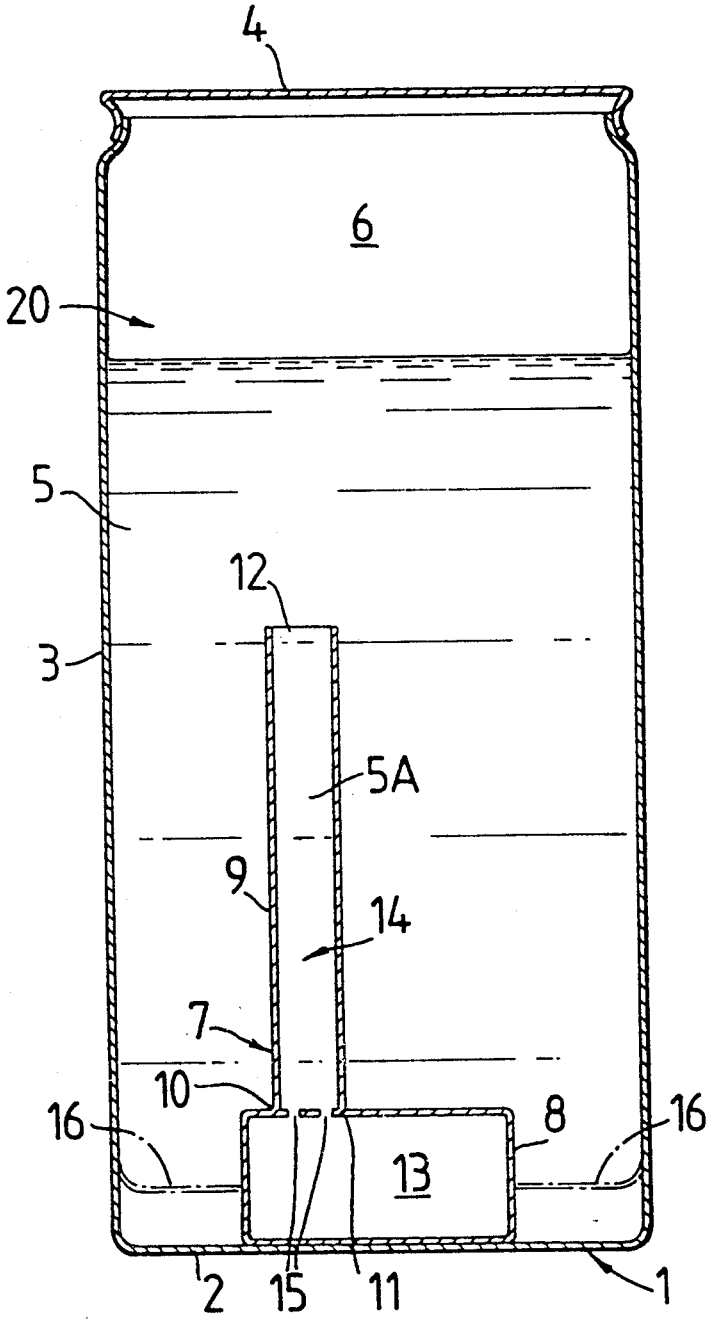
FIG. 1 shows a section through the sealed package of a first embodiment.

The beverage package of each embodiment shown comprises a conventional form of container such as a light metal can 1 having a circular base 2 on which the package will normally stand, a cylindrical side wall 3 and a circular top 4 which will usually be seamed to the side wall 3 to seal the container. The top 4 will be openable, typically by a ring pull or other conventional means for the purpose of dispensing the beverage. In the present examples, the can 1 will be regarded as having a capacity of 500 milliliters.

The sealed can 1 provides a primary chamber 20 within which is accommodated, say, 440 milliliters of beverage in the form of a light beer or lager 5 which creates a headspace 6. Generally the beverage will form a headspace of 5% to 15% of the capacity of the container (in the present example the can 1). The beer 5 has in solution a mixture of carbon dioxide and nitrogen gases, typically the carbon dioxide gas content is 1.75 to 2.50 grams/liter and the nitrogen gas content is 3% to 5% vols./vol. The term "vols./vol" is well known in the art but a definition of the term may be found in our British Patent No. 1,588,624. During the formation of the beverage package the headspace 6 is pressurised with nitrogen gas, typically to a pressure in the range of 1.5 to 3.0 atmospheres. The means for pressurising the headspace 6 is well known in the art and is conveniently effected by dosing the headspace with liquid nitrogen or other inert gas immediately prior to fitting the top 4 and sealing the container. Located in the primary chamber 20 is an insert 7 conveniently formed by plastics moulding.

In the embodiment of FIG. 1 the insert 7 is submerged in the beer 5 and comprises a generally cylindrical hollow drum 8 which sits with its axis extending upwardly on or adjacent to the can base 2 and a tubular part or chimney 9 which extends upwardly within the beer 5. The bottom end 10 of the chimney 9 is sealed to a top wall 11 of the drum 8 while the top end 12 of the chimney 9 opens into the beverage 5 in the primary chamber. The drum 8 forms a secondary chamber 13 while the chimney 9 provides an intermediate chamber 14 which is filled with beverage 5A derived through the top opening 12 from the beverage 5 in the primary chamber. Communicating between the secondary chamber 13 and the intermediate chamber 14 is a restricted orifice or several such orifices 15 formed in the drum wall 11. The secondary chamber 13 contains gas, usually nitrogen, under pressure which is in equilibrium with the pressurised headspace 6. The or each restricted orifice 15 is formed as a circular aperture the diameter of which is sufficiently small to alleviate the transfer of gas/beer therethrough (by the surface tension characteristics of the beer at the restricted orifice) while the container is sealed and its contents are in equilibrium and during vibration or handling to which the package may reasonably be subjected. It is possible however that a small volume of beer will seep into the secondary chamber 13 and lie in the bottom of that chamber during the initial filling stages of the package and prior to the contents coming into equilibrium in the sealed container.

In the present example and typically the secondary chamber 13 has a volume of 16 milliliters. The chimney 9 has a bore diameter of 6 millimeters and a height of 80 millimeters. Of the 440 milliliters of beer in the package, approximately 100 milliliters of such beer will be accommodated above the level of the chimney opening 12. Four circular apertures 15 provide communication between the chambers 13 and 14, each aperture, typically, being in the range of 0.03 to 0.23 millimeters diameter.

The insert 7 is conveniently retained with its hollow drum 8 securely seated on the base 2 by resilient flanges 16 on the drum frictionally engaging with the side wall 3 of the can in known manner.

On opening the top 4 of the can to dispense the beer 5 into a drinking glass for consumption, the headspace 6 is opened to atmospheric pressure and rapidly depressurises. As a consequence the pressure of gas in the secondary chamber 13 exceeds the pressure in the headspace 6 and creates a pressure differential through the restricted apertures 15. This causes gas to be ejected from the chamber 13 through the apertures 15 and injected as high energy jets into the bottom of the column of beer 5A within the intermediate chamber 14. This injection of gas is believed to develop active or nucleation sites in the beer which causes the gas in solution to evolve. The evolution of gas is initiated in the bottom end of the beer column 5A and rapidly grows to rise throughout that column within the intermediate chamber 14 whilst being contained by the wall of the chimney 9 from spreading laterally. As the gas evolution develops and rises through the beer column 5A, it will eventually spread, with relatively low energy, from the upper open end 12 of the chimney. This can cause further evolution of gas from the beer 5 in the primary chamber 2 which is at a level above the chimney opening 12 and the evolution of gas develops a head of froth on the beverage 5. As a consequence of the isolating effect provided by the chimney 9 to localise the beer from which gas evolution is initiated by the gas injection, a considerable proportion of the volume of the beer within the container will retain gas, particularly carbon dioxide, in solution. Therefore when the beer is poured from the can 1 into a drinking glass shortly after opening the can, the froth developed by the evolution of gas from part only of the beverage may provide a desirable head on the beer in the glass while adequate gas is maintained in solution in the beer in the glass for such gas to evolve gradually and naturally to present a slight effervescent effect or "sparkle" to the body of the beer—this is considered most desirable for aesthetic quality in lager or light beer and may also enhance the flavour characteristics and mouth feel of the beer.

Figure 2:
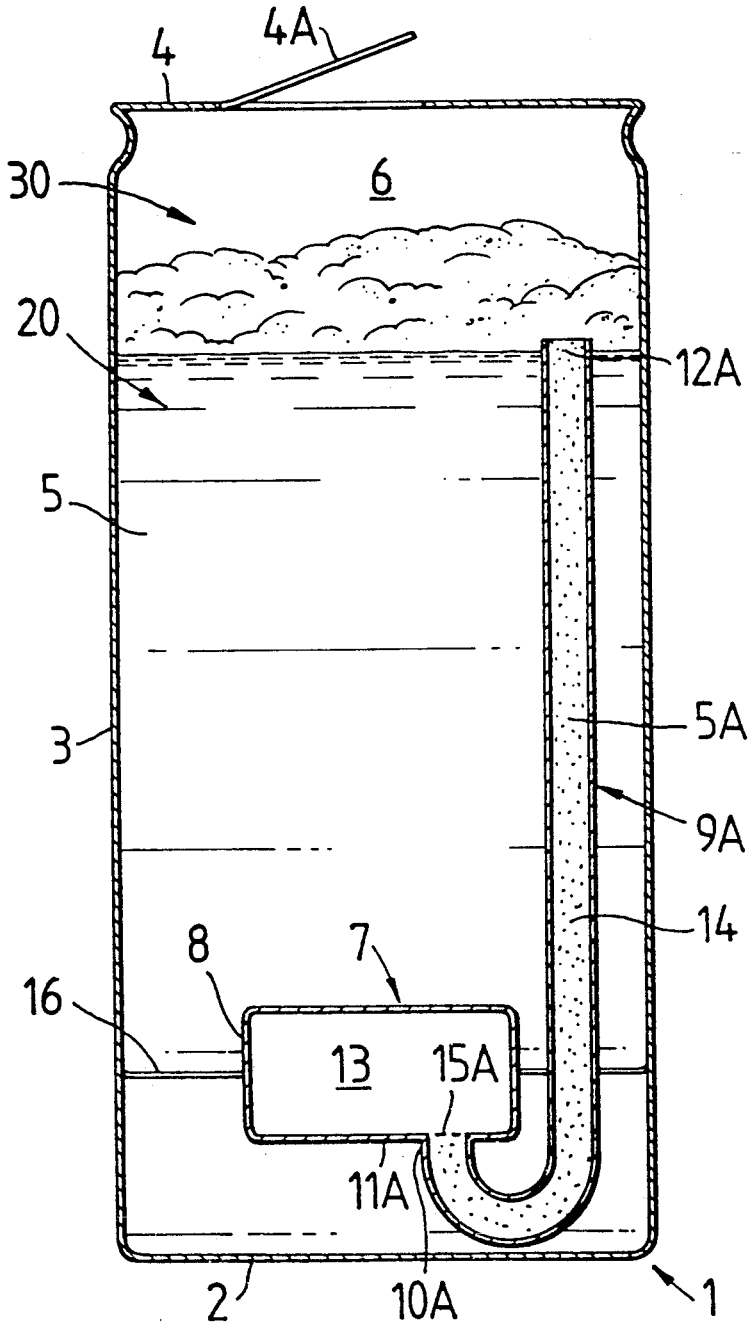
FIG. 2 shows a section through the package of the second embodiment following opening of that package.

In the embodiment shown in FIG. 2, the insert 7 is retained by the flanges 16 with its hollow drum 8 submerged in the beer 5. Similarly to the first embodiment, the insert 7 includes a generally upstanding tubular part or chimney 9A; this chimney 9A however has a U-bend which permits a lower end 10A of the chimney to be sealed to a bottom wall 11A of the drum 8. The predominant part length of the chimney 9A extends upwardly through the beer 5 so that the top end 12A of the chimney opens into the primary headspace 6. The intermediate chamber 14 formed by the chimney 9A consequently communicates directly with the primary headspace. Communicating between the secondary chamber 13 formed by the insert drum 8 and the intermediate chamber 14 are one or more restricted orifices 15A which are formed in the bottom drum wall 11A and are directed downwardly into the chamber 14. In the sealed package, the secondary chamber 13 contains gas under pressure which is in equilibrium with the pressurised headspace 6 while the chimney 9A is charged, usually filled, with beverage 5A which is preferably and conveniently derived from the beverage 5 in the primary chamber 20. To ensure that the intermediate chamber 14 is appropriately charged with beverage, after the can 1 has been sealed in an upstanding condition it may be rapidly inverted immediately following sealing and then re-inverted to its upstanding condition thereby causing beverage to flow from the primary chamber 20 into the intermediate chamber 14 as the fluid contents of the can come into equilibrium. As the can fluid contents come into equilibrium it is possible that some beer will flow from the intermediate chamber 14 into the secondary chamber 13 by way of the restricted orifice 15A to form a secondary headspace (not shown) in the secondary chamber 13. In this latter event it may be possible that beverage rather than gas is initially injected downwardly through the restricted orifices 15A into the beverage 5A to effect the evolution of gas from solution for froth formation. The various volumes and dimensions of the insert 7 shown in FIG. 2 will be similar to those mentioned for the insert in FIG. 1 except that the chimney 9A will typically have a diameter in the range of 0.2 to 3.0 mms and will be of greater length than the chimney 9. Also it is possible that the restricted orifices 15A can be of relatively large diameter (typically in the range 0.5 to 2.0 mms) as compared with the orifices 15 by virtue of the fact that the orifices 15A are directed downwardly in the beverage and there is therefore less likelihood that excess beverage will inadvertently enter the secondary chamber 13 (compared with the upwardly directed restricted orifices as in FIG. 1) during vibration to which the sealed package may be subjected during its transportation.

When the sealed package of the second embodiment is opened, for example by a ring pull 4A as shown in FIG. 2, to dispense the beer 5, the headspace 6 is opened to atmospheric pressure and rapidly de-pressurises. Similarly to the first described embodiment, this causes fluid (gas and/or beer) to be ejected from the chamber 13 through the apertures 15A but this ejection is effected downwardly as high energy jets into the lower end of the beer 5A within the intermediate chamber 14. Gas in solution is thereby caused to be evolved from the beverage 5A. The evolution of the gas is initiated in the region of the beverage 5A adjacent to the end 10A of the chimney 9A but this grows rapidly throughout the beer within the intermediate chamber 14 but is contained by the wall of the chimney 9A from spreading laterally. As the upper end 12A of the chimney 9A is located within the primary headspace 6 the evolution of gas from the beverage is confined to such beverage 5A as is within the secondary chamber 14. Therefore froth or foam 30 can develop from the beverage 5A in the intermediate chamber and the gas which is released from solution in that beverage 5A. This froth or foam 30 can build-up and spread within the headspace 6 to float on the surface of the beverage 5 within the primary chamber and be dispensed along with the beverage 5 as it is poured from the can. As a consequence of the isolating effect provided by the chimney 9A to confine the gas evolution to the beverage within that chimney, all of the beverage 5 within the primary chamber 20 will retain gas, particularly carbon dioxide, in solution.

Therefore when the beer is poured from the can 1 into a drinking vessel, the froth 30 developed by the evolution of gas from the beer 5A within the chimney 9A may provide a desirable head on the beer in the glass while adequate gas is maintained in solution in the beer in the glass for such gas to evolve gradually and provide the desirable characteristics as previously discussed.

Although in the above described and illustrated embodiments the restricted orifices 15 and 15A are in constant communication between the secondary and intermediate chambers, it will be appreciated that a nonreturn valve can be associated with the restricted orifice to alleviate the seepage of beer into the secondary chamber and be responsive to the previously mentioned pressure differential that is created on opening of the package to open and permit the required gas injection. It is also envisaged that beer can be ejected from the secondary chamber by way of the restricted orifice in a similar manner to that disclosed in our European Patent No. 0 227 213 with such beer injection being applied to beer in the intermediate chamber. It will also be appreciated that the insert 7 may be structured differently from those illustrated, for example, the insert 7 shown in FIG. 2 may have the lower U-bend part length of its chimney 9A formed integral with the moulding of the drum 8.

We claim:

1. A beverage package comprising a sealed container having a primary chamber containing beverage having gas in solution therewith and forming a primary headspace comprising gas at a pressure greater than atmospheric; a secondary chamber containing gas at a pressure greater than atmospheric and having a restricted orifice which communicates with an intermediate chamber containing beverage, said intermediate chamber opening to the primary chamber at a position remote from the bottom of the beverage in the primary chamber, and wherein said package is openable to open the primary headspace to atmospheric pressure and said opening creates a pressure differential causing gas and/or beverage in the secondary chamber to be ejected by way of the restricted orifice into the beverage in the intermediate chamber and said ejection causes gas in solution to be evolved from the beverage in the intermediate chamber for forming froth in the primary headspace.

2. A package as claimed in claim 1 in which the beverage in the intermediate chamber is derived from the primary chamber.

3. A package as claimed in claim 1 in which the intermediate chamber opens into the beverage in the primary chamber and on opening the package the injection of gas and/or beverage causes gas in solution to be evolved from the beverage in the intermediate chamber and this evolution develops upwardly through the beverage in the intermediate chamber and into the beverage in the primary chamber remote from the bottom of that beverage in the primary chamber.

4. A package as claimed in claim 1 in which the intermediate chamber opens into the primary headspace whereby on opening the package said evolution of gas is confined to beverage in the intermediate chamber and froth developed thereby can flow into the primary headspace to be dispensed.

5. A package as claimed in claim 1
in which beverage is contained in the intermediate chamber as a column and wherein said beverage column communicates at its upper end with the primary chamber and on opening the package gas and/or beverage from the secondary chamber is injected into the lower end region of said beverage column.

6. A package as claimed in claim 1
in which on opening the package gas and/or beverage is ejected from the secondary chamber by way of the restricted orifice into the intermediate chamber and said restricted orifice is located for said ejection to be directed downwardly, upwardly or sideways into the beverage in the intermediate chamber.

7. A package as claimed in claim 1
in which the restricted orifice is located at or towards the bottom of the container.

8. A package as claimed in claim 1
in which the secondary and intermediate chambers are formed by an insert that is located in the primary chamber.

9. A package as claimed in claim 8 in which the insert comprises a hollow part forming the secondary chamber and a tubular part extending upwardly from the hollow part, the tubular part forming the intermediate chamber and having its upper end open to receive beverage therethrough while the restricted orifice from the secondary chamber communicates with the lower end region of the intermediate chamber in the tubular part.

10. A package as claimed in claim 9 in which the tubular part has a U-bend and a lower end of that part extends from the hollow part for the gas and/or beverage ejection from the secondary chamber to be directed downwardly by the restricted orifice into the beverage in the intermediate chamber.

11. A package as claimed in claim 8 in which the insert comprises a plastics moulding.

* * * * *